United States Patent [19]

Whitney et al.

[11] Patent Number: 4,935,664

[45] Date of Patent: Jun. 19, 1990

[54] DIFFUSE DISCHARGE LAMP

[75] Inventors: Fred Whitney, Salem; Paul A. Thibault, Danvers; Jakob Maya, Brookline, all of Mass.

[73] Assignee: GTE Products Corporation, Danvers, Mass.

[21] Appl. No.: 246,607

[22] Filed: Sep. 20, 1988

[51] Int. Cl.[5] ..... H01J 63/02

[52] U.S. Cl. ..... 313/493; 313/491; 313/573; 313/574; 313/610; 313/634

[58] Field of Search ..... 313/491, 493, 573–575, 313/634, 610, 572

[56] References Cited

U.S. PATENT DOCUMENTS

| | | | |
|---|---|---|---|
| 2,473,642 | 6/1949 | Found et al. | 313/572 X |
| 3,551,736 | 12/1970 | Doehner | 313/493 |
| 3,609,436 | 9/1971 | Campbell | 313/493 |
| 4,177,401 | 12/1979 | Yamane et al. | 313/493 X |
| 4,438,373 | 3/1984 | Watanabe et al. | 313/610 X |
| 4,461,981 | 7/1984 | Saikatsu et al. | 313/572 |
| 4,582,523 | 4/1986 | Marcucci et al. | 65/109 |

FOREIGN PATENT DOCUMENTS

| | | | |
|---|---|---|---|
| 204468 | 11/1983 | Japan | 313/610 |
| 240048 | 11/1985 | Japan | 313/493 |

*Primary Examiner*—Donald J. Yusko
*Assistant Examiner*—Michael Horabik
*Attorney, Agent, or Firm*—Carlo S. Bessone

[57] ABSTRACT

A low pressure mercury vapor discharge lamp having a double-tube type discharge vessel consisting of a closed outer glass bulb and an inner glass tube coaxially disposed within the outer bulb. An electrode is disposed in the inner glass tube, while a ring-shaped electrode structure is disposed in the outer envelope outside the inner glass tube. The electrode structure completely surrounds the inner glass tube and includes a pair of lead-in wires and a pair of semicircular electrode sections. Preferably, an inert gas having a pressure within the range of from about 4.0 to 6.0 torr and a quantity of mercury are contained within the lamp. The lamp of the present invention provides a fully diffused discharge without requiring an expensive transistor switching circuit or a permanent magnet to rotate the discharge about the inner tube.

18 Claims, 2 Drawing Sheets

DIFFUSE DISCHARGE LAMP

CROSS-REFERENCE TO ANOTHER APPLICATION

U.S. Pat. application Ser. No. 07/246,606, filed concurrently herewith and assigned to the same Assignee as the present Application, contains related subject matter.

TECHNICAL FIELD

This invention relates to an improvement in low pressure metal vapor discharge lamps and, more particularly, to a single base diffuse discharge lamp having a double-tube structure.

BACKGROUND OF THE INVENTION

A conventional low pressure metal vapor discharge lamp, as typically exemplified in a fluorescent lamp, has an elongated glass tube provided at both ends with electrodes and accommodating a rare gas of several torrs pressure and a small amount of a metal such as mercury. This type of lamp has a relatively long length which makes it inconvenient for many applications where a more compact light source is required.

Compact fluorescent lamps in the past have generally consisted of folded or bent glass tubing configured to obtain a desired arc length and lamp voltage. While the size of such packages is compatible with the size of an incandescent bulb, they require intricate bending of the lamp tube to achieve this, and in some cases a connecting "kiss joint" is required to join two glass tube sections together to obtain the desired arc length. These lamps, while highly efficient, are difficult and costly to manufacture.

In an attempt to satisfy the above demand, a lamp has been proposed which has a double-tube structure consisting of a fully closed outer glass bulb and an inner glass tube disposed within the outer glass bulb. The inner glass tube is open at one end but closed at the other end. One of the electrodes (cathode) is disposed within the inner glass tube adjacent the closed end, while the other electrode (anode) is disposed outside the inner glass tube. According to this arrangement, the discharge path formed between the two electrodes makes a turn at the open end of the inner glass tube, so that a sufficiently large length of the discharge path can be obtained with a relatively small overall length.

This known double-tube type of discharge lamp, however, has a problem in that it is difficult to uniformly distribute the discharge plasma over the entire discharging space between the inner glass tube and the outer glass bulb. More specifically, the discharge plasma outside the inner glass tube is concentrated locally to the region which exhibits the smallest resistance to the discharge current, and is not spread uniformly over the entire discharging space. It was believed that this local concentration of the discharge plasma could not be avoided even by the use of a ring-shaped anode disposed around the inner glass tube. In such a lamp, the luminous intensity is specifically high only at the region to which the plasma is locally concentrated, while only a low luminous intensity is obtained at portions of the lamp where the plasma is not distributed. Thus, it is difficult to obtain a uniform luminous intensity distribution over the entire lamp body.

In order to overcome the problem concerning the local concentration of the plasma in the known double-tube type fluorescent lamp, various solutions have been proposed. For example, U.S. Pat. No. 3,609,436 which issued to Campbell, proposes an improved lamp in which a plurality of anodes are disposed around the inner glass tube. These anodes are switched successively so as to forcibly rotate the locally concentrating plasma at a high speed around the inner glass tube to thereby achieve luminous intensity over the entirety of the lamp.

This improved lamp, however, requires a complicated and rather expensive transistor switching circuit for a high-speed switching of the voltage over the successive anodes and, therefore, is not practical from both technological and economical points of view.

Another proposed solution is described in U.S. Pat. No. 4,177,401, which issued to Yamane et al. This patent teaches a lamp wherein a single anode or alternatively a plurality of anodes is disposed around the inner glass tube. A permanent magnet is disposed near the open end of the inner glass tube for applying a magnetic field of a fixed intensity near the open end causing the discharge plasma to rotate about the axis of the discharge lamp.

In addition to requiring the added cost of the permanent magnet, the above lamp further requires that the outer glass bulb be modified to provide a tubular recess to accommodate the magnet.

Alternatively, U.S. Pat. No. 4,438,373, which issued to Watanabe et al, teaches notching the open end of the inner tube in alignment with a pair of anodes and using an inner glass tube having a non-circular cross-section.

BRIEF SUMMARY OF THE INVENTION

It is, therefore, an object of the present invention to obviate the disadvantages of the prior art.

It is still another object of the invention to provide a practical and less expensive double-tube type low pressure metal vapor discharge lamp in which the local concentration of the discharge plasma and unstable behavior of the same are avoided to ensure a materially uniform and stable light output distribution over the entirety of the lamp, without necessitating the complicated and expensive switching circuit which is used in the above-mentioned existing lamp.

It is still another object of the invention to provide a double tube-type low pressure metal vapor discharge lamp which does not require the addition of a permanent magnet to cause the discharge plasma to rotate about the axis of the discharge lamp or modifications to the outer glass envelope.

It is yet another object of the invention to provide a double tube-type low pressure metal vapor discharge lamp which does not require modifying the open end of the inner glass tube.

These objects are accomplished in one aspect of the invention by the provision of a low pressure metal vapor discharge lamp comprising an outer glass envelope defining an enclosed discharge space and an inner glass tube disposed within the outer glass envelope. The tube is open at one end thereof and closed at the other end. An electrode is disposed in the inner glass tube and supported by a first pair of lead-in wires. An electrode structure is disposed in the outer glass envelope outside the inner glass tube and includes a second pair of lead-in wires and a pair of semicircular electrode sections. Each of the sections join the second pair of lead-in wires so as to comPletely surround the inner glass tube. An inert gas having a pressure within the range of from about 4.0 to 6.0 torr and a quantity of mercury is contained within the metal vapor discharge lamp.

In accordance with further teachings of the present invention, an inert gas having a pressure within the range of from about 3.5 to 4.0 torr and a quantity of mercury is contained within the metal vapor discharge lamp. The mercury has a mercury vapor pressure within the range of from about 8.0 to 10.0 microns. The operating current of the lamp is defined as being greater than 700 milliamps.

In accordance with further aspects of the present invention, an inert gas having a pressure within the range of from about 6.0 to 8.0 torr and a quantity of mercury is contained within the metal vapor discharge lamp. The mercury has a mercury vapor pressure greater than about 8.0 microns. The operating current of the lamp is greater than about 600 milliamps.

In accordance with still further teachings of the present invention, the outer glass bulb and the inner glass tube have inner surfaces coated with phosphor. Preferably, the outer surface of the inner glass tube is also coated with phosphor.

In accordance with still further aspects of the present invention, the inner glass tube contains a plurality of constricting portions axially spaced and extending about the periphery of the tube to increase the operating voltage of the lamp.

In accordance with yet another aspect of the present invention, the first and second pairs of lead-in wires and the closed end of the inner glass tube are coupled together by a press seal.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended Claims in connection with the above-described drawings.

Figure 1:
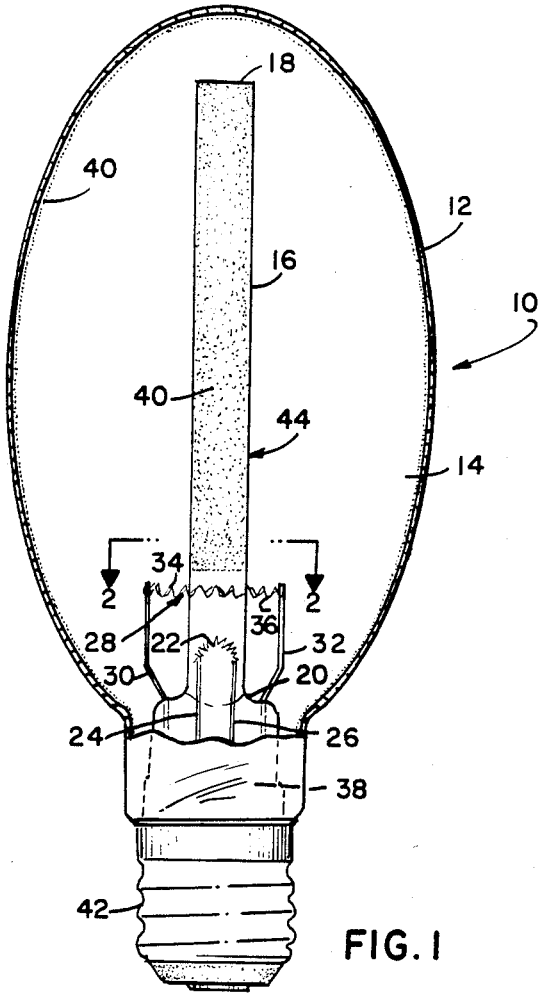
FIG. 1 represents a front elevational view, partially broken away, of a low pressure metal vapor discharge lamp according to the present invention.
Figure 2:
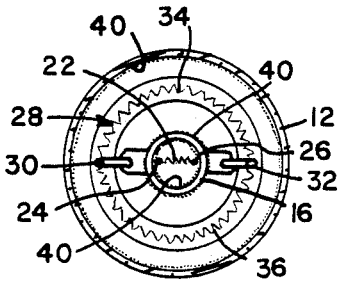
FIG. 2 is a top plan view of the lamp in FIG. 1 taken along the line 2—2.

Referring to the drawings, FIGS. 1 and 2 illustrate a low pressure metal vapor discharge lamp 10 comprising an outer glass envelope 12 defining an enclosed discharge space 14 and an inner glass tube 16 concentrically disposed within the outer glass envelope. Tube 16 has an open end 18 and a closed end 20. An electrode 22 is disposed within closed end 20 of inner glass tube 16 and supported by a pair of lead-in wires 24, 26 which extend through a press seal 48. As best shown in FIG. 2, an electrode structure 28 is disposed in outer glass envelope 12 outside inner glass tube 16 and includes a pair of lead-in wires 30, 32 and a pair of semicircular electrode sections 34, 36. The semicircular sections of the electrode structure lie in a plane perpendicular to a plane extending longitudinally along the lamp axis. Each of the sections 34, 36 join the pair of lead-in wires 30, 32 so as to form a continuous ring-type filamentary electrode which completely surrounds inner glass tube 16. By "continuous" is meant that the filament portion of the electrode forms a closed circle without openings. The ring-type electrode may be formed from a single filamentary coil or from two separate filamentary coils. In the latter case, each coil will comprise one of the semicircular electrode sections and has a cold and hot resistance equal to that of electrode 22. The electrode 22 and electrode sections 34, 36 are coated with an emissive material.

The continuous ring-type electrode functions as a quasi-equipotential surface when viewed by the discharge. As a result of the circular symmetry and its behavior as a quasi-constant voltage surface, the discharge does not favor a preferred path during lamp operation.

The inner surface of outer glass envelope 12 is coated with phosphor 40. Preferably the inner and outer surfaces of inner glass tube 16, as illustrated in FIG. 2, are also coated with phosphor 40. Inner glass tube 16 is coated with phosphor to take advantage of ultraviolet light produced within the inner tube 16 and to permit the outer surface of the tube to be available for ultraviolet photon conversion to visible light. Without the outer phosphor coating on the inner tube, there are some losses of ultraviolet photons by absorption of the bare glass surface on the inner tube with no visible light production. While coating the outer surface of the inner tube is considered desirable, it may not be required in some applications.

If inner glass tube 16 is made of quartz, no phosphor is needed on the inner tube.

A suitable base 42 may be secured to the lower end on lamp 10 for electrical connection to the lamp electrodes. A glow bottle starter or series resonant capacitor is disposed within base 42 and connected to lead-in wires 24 and 30 so as to allow for preheating of the lamp electrodes.

An inert rare gas fill and a quantity of mercury are contained within the lamp. The gas fill may comprise, for example, argon, neon or a Penning mix of 99.5/0.5 Ne/Ar.

It has been determined that various lamp characteristics such as the rare gas fill pressure, the mercury vapor pressure and the lamp operating current affects the diffuseness of the discharge. For producing a fully diffuse discharge, a fill pressure within the range of from about 3.5 torr to 8 torr is recommended. By a "fully diffuse discharge" is meant that a measurement of light output as a function of spacial position and a total difference of no more than 10 percent found between the maximum and minimum readings for all spatial positions. A decrease in pressure below about 3.5 torr for constant mercury vapor pressure will result in an unstable and sometimes constricted discharge. Lamp pressures over 8 torr with constant mercury vapor pressure will produce stable but constricted discharges, with the degree of constriction increasing with increasing rare gas fill pressure.

It has been discovered that within a pressure range of from about 3.5 torr to 4.0 torr, a fully diffuse discharge is achieved by maintaining the mercury vapor pressure within the range of from 8 to 10 microns and the lamp operating current greater than about 700 milliamps. The mercury vapor pressure can easily be maintain within the desired range by externally heating a portion of the outer envelope.

Within the range of from about 4.0 torr to 6.0 torr the lamp will operate with fully diffuse discharge. The diffuseness of the discharge is unaffected by the lamp operating current and weakly affected by the mercury partial pressure.

To maintain a fully diffuse discharge when the pressure of the lamp is within the range of from 6 to 8 torr, requires a lamP current greater than about 600 milliamps but less than 1.0 amp. As in the lower pressure range, the mercury vapor pressure must be greater than about 8 microns.

For current densities greater than about 1 ampere per centimeter$^2$, it may be necessary to employ a suitable mercury amalgam in the inner tube to prevent the possibility of ionization depletion of the mercury in the inner tube over time. The amalgam may be fashioned into a flag shape, or any other suitable shape, and attached to one of the inner electrode lead-in wires. This amalgam serves as a source of mercury, thus preventing ionization depletion of the mercury in the inner tube and preventing possible degradation of lamp performance.

Figure 3:
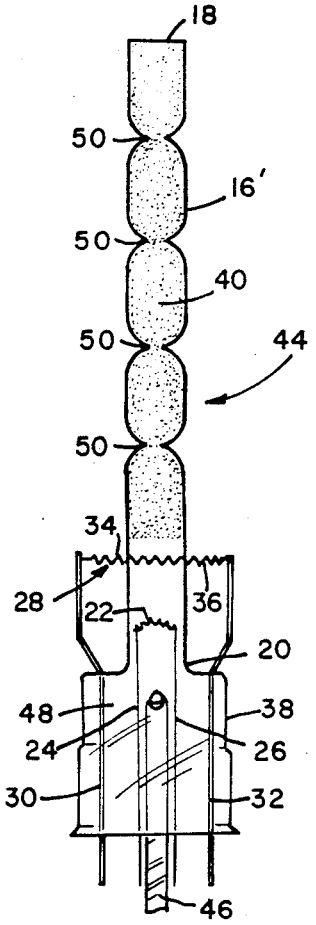
FIG. 3 is a front elevational view of an embodiment of a stem for use in the lamp of FIG. 1.
Figure 4:
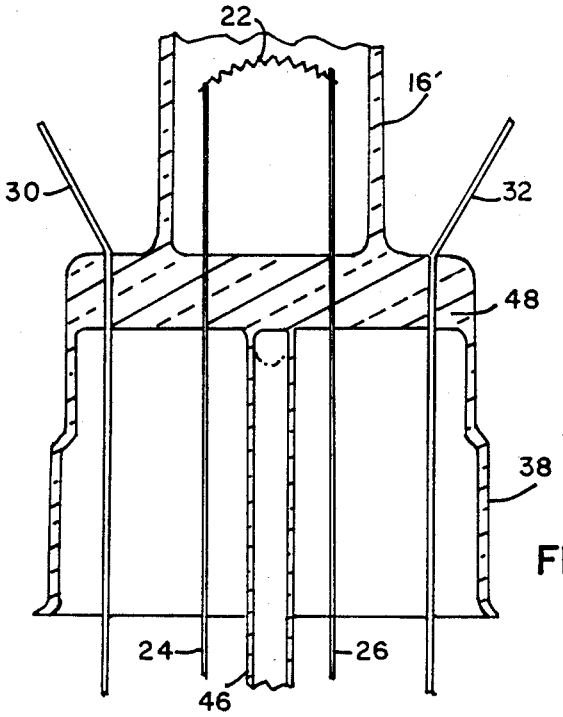
FIG. 4 is an exploded, cross-sectional partial view of the stem of FIG. 3.

With particular attention to FIGS. 1, 3 and 4, the lamp of the present invention is constructed by assembling a lamp stem 44 which includes phosphor-coated inner tube 16 (FIG. 1), 16' (FIGS. 3 and 4), glass flare 38, lead-in wires 24, 26 supporting electrode 22, lead-in wires 30, 32 supporting electrode sections 34, 36 and an exhaust tube 46. Inner tube 16, 16' and glass flare 38 are concentrically positioned and the four lead-in wires are arranged in a common plane.

As shown in FIG. 3, inner tube 16' contains a plurality of constricting portions 50 axially spaced and extending about the periphery of the tube as described in U.S. Pat. No. 4,582,523, which issued to Marcucci et al and is assigned to the same Assignee as the present Application. Constricting portions 50 increase the operating voltage of the lamp for a given length. As a result, a lamp with more power and light output is created in a smaller or at least comparably sized lamp package without bending or folding the lamp tubing.

In manufacturing the mount stem, lead-in wires 24, 26, 30, 32 are arranged substantially in parallel with each other and in a common plane. The inner electrode 22 is mounted on the two inner lead-in wires 24, 26. The lead-in wires are positioned within the upper portion of glass flare 38 which has a cylindrical shape prior to sealing. The lower end of inner tube 16 or 16' (which is initially open) is concentrically positioned within the upper portion of the glass flare and surrounding electrode 22.

The upper Portion of glass flare 38 and the lower end of inner glass tube 16 are heated before the formation of a single press seal. Formation of the seal joins lead-in wires 24, 26, 30, 32 and the lower end of inner tube 16 to glass flare 38. Finally, electrode 28 is mounted on lead-in wires 30, 32.

The press seal not only closes the lower end of inner tube 16 but also creates an hermetic seal having a high insulating dielectric strength between the inner and outer lead-in wires and between the inner and outer electrodes. The raised inner tube 16, 16' affords total isolation to the electrodes. Since the inner tube can be made to any length, by sealing glass tubing of the appropriate length to the existing inner tube or by using the appropriate length during pressing, any desired arc length equal to approximately twice the inner tube length is possible. This stem construction also allows for the sealing of the inner glass tube of diameters other than the inner diameter, as well as changing the tube diameter before pressing to keep a uniform tube diameter. This affords a constricting or opening of the discharge in the inner tube based on the choice of tube diameter.

After the mount stem 44 has been assembled, glass flare 38 is sealed to the open end of a phosphor-coated outer glass envelope 12. Thereafter, the lamp is processed in a conventional manner using known manufacturing techniques.

There has thus been shown and described an improved double-tube discharge lamp which provides a fully diffused discharge without necessitating complicated and expensive switching circuits or a permanent magnet. A simplified ring-type electrode surrounding the inner tube is used instead of a plurality of anodes. Furthermore, the lamp of the present invention does not require modifying the open end of the inner glass tube or the outer glass bulb.

While there have been shown and described what are at present considered to be the preferred embodiments of the invention, it will be apparent to those skilled in the art that various changes and modifications can be made herein without departing from the scope of the invention. The embodiments shown in the drawings and described in the specification are intended to best explain the principles of the invention and its practical application to hereby enable others in the art to best utilize the invention in various embodiments and with various modifications as are suited to the particular use contemplated.

What is claimed is:

1. A low pressure metal vapor discharge lamp comprising:

an outer glass envelope defining an enclosed discharge space;

a single inner glass tube disposed within said outer glass envelope, said tube being open at one end thereof and closed at the other end;

an electrode disposed in said inner glass tube and supported by a first pair of lead-in wires;

an electrode structure disposed in said outer glass envelope outside said inner glass tube, said electrode structure including a second pair of lead-in wires and a pair of semicircular electrode sections, each of said sections joining said second pair of lead-in wires so as to completely surround said inner glass tube; and an inert gas having a pressure within the range of from about 4.0 to 6.0 torr and a quantity of mercury contained within said metal vapor discharge lamp, said pressure of the inert gas being sufficient to produce a fully diffuse discharge within said outer glass envelope.

2. The low pressure metal vapor discharge lamp of claim 1 wherein said outer glass bulb has an inner surface coated with phosphor.

3. The low pressure metal vapor discharge lamp of claim 1 wherein said inner glass tube has an inner surface coated with phosphor.

4. The low pressure metal vapor discharge lamp of claim 3 wherein said inner glass tube has an outer surface coated with phosphor.

5. The low pressure metal vapor discharge lamp of claim 1 wherein said inner glass tube contains a plurality of constricting portions axially spaced and extending about the periphery of said tube to increase the operating voltage of said lamp.

6. The low pressure metal vapor discharge lamp of claim 1 wherein said first and second pairs of lead-in wires and said closed end of said inner glass tube are coupled together by a press seal.

7. A low pressure metal vapor discharge lamp comprising:

an outer glass envelope defining an enclosed discharge space;

a single inner glass tube disposed within said outer glass envelope, said tue being open at one end thereof and closed at the other end;

an electrode disposed in said inner glass tube and supported by a first pair of lead-in wires;

an electrode structure disposed in said outer glass envelope outside said inner glass tube, said electrode structure including a second pair of lead-in wires and a pair of semicircular electrode sections, each of said sections joining said second pair of lead-in wires so as to completely surround said inner glass tube;

an inert gas having a pressure a pressure within the range of from about 3.5 to 4.0 torr and a quantity of mercury contained within said metal vapor discharge lamp, said mercury having a mercury vapor pressure within the range of from about 8.0 to 10.0 microns; and an operating lamp current greater than 700 ; milliamps;

said pressure of said inert gas, said mercury vapor pressure and said operating lamp current being sufficient to produce a fully diffuse discharge within said outer glass envelope.

8. The low pressure metal vapor discharge lamp of claim 7 wherein said outer glass bulb has an inner surface coated with phosphor.

9. The low pressure metal vapor discharge lamp of claim 7 wherein said inner glass tube has an inner surface coated with phosphor.

10. The low pressure metal vapor discharge lamp of claim 9 wherein said inner glass tube has an outer surface coated with phosphor.

11. The low pressure metal vapor discharge lamp of claim 7 wherein said inner glass tube contains a plurality of constricting portions axially spaced and extending about the periphery of said tube to increase the operating voltage of said lamp.

12. The low pressure metal vapor discharge lamp of claim 7 wherein said said first and second pairs of lead-in wires and said closed end of said inner glass tube are coupled together by a press seal.

13. A low pressure metal vapor discharge lamp comprising:

an outer glass envelope defining an enclosed discharge space;

a single inner glass tube disposed within said outer glass envelope, said tube being open at one end thereof and closed at the other end;

an electrode disposed in said inner glass tube and supported by a first pair of lead-in wires;

an electrode structure disposed in said outer glass envelope outside said inner glass tube, said electrode structure including a second pair of lead-in varies and a pair of semicircular electrode sections, each of said sections joining said second pair of lead-in wires so as to completely surround said inner glass tube;

an inert gas having a pressure within the range of from about 6.0 to 8.0 torr and a quantity of mercury contained within said metal vapor discharge lamp,, aid mercury having a mercury vapor pressure greater than about 8.0 microns; and an operating lamp current greater than about 600 milliamps;

said pressure of said inert gas, said mercury vapor pressure and said operating lamp current being sufficient to produce a fully diffuse discharge within said outer glass envelope.

14. The low pressure metal vapor discharge lamp of claim 13 wherein said outer glass bulb has an inner surface coated with phosphor.

15. The low pressure metal vapor discharge lamp of claim 13 wherein said inner glass tube has an inner surface coated with phosphor.

16. The low pressure metal vapor discharge lamp of claim 15 wherein said inner glass tube has an outer surface coated with phosphor.

17. The low pressure metal vapor discharge lamp of claim 13 wherein said inner glass tube contains a plurality of constricting portions axially spaced and extending about the periphery of said tube to increase the operating voltage of said lamp.

18. The low pressure metal vapor discharge lamp of claim 13 wherein said said first and second pairs of lead-in wires and said closed end of said inner glass tube are coupled together by a press seal.

* * * * *